United States Patent [19]

Barrer

[11] 4,109,902

[45] Aug. 29, 1978

[54] APPARATUS FOR THE CONTINUOUS ZIGZAG FOLDING OF A MATERIAL WEB

[75] Inventor: Robert Barrer, Muri, Switzerland

[73] Assignee: Faltex Handels AG, Hergiswil, Switzerland

[21] Appl. No.: 784,282

[22] Filed: Apr. 4, 1977

[30] Foreign Application Priority Data

Apr. 22, 1976 [CH] Switzerland ..... 5041/76

[51] Int. Cl.[2] ..... B65H 45/20

[52] U.S. Cl. ..... 270/79

[58] Field of Search ..... 270/67, 39, 68 A, 68 R, 270/79-85; 93/84 R

[56] References Cited

U.S. PATENT DOCUMENTS 1,283,108 10/1918 Dexter ..... 270/79

*Primary Examiner*—Edgar S. Burr
*Assistant Examiner*—A. Heinz
*Attorney, Agent, or Firm*—Werner W. Kleeman

[57] ABSTRACT

An apparatus for the continuous zigzag-shaped folding of a material web, comprising an infeed station for the material web and two conveying or feed gaps arranged following the outfeed or discharge portion of the infeed station and each disposed to one respective side of said infeed station. The conveying or feed gaps are positioned to receive the material web delivered by the infeed station. The direction of conveying of the material web at any one conveying gap is always opposite to the direction of conveying of the other conveying gap. Further, means are provided in order to repetitively reverse the respective conveying directions of both conveying gaps. Each conveying gap has operatively associated therewith a folding blade or sword which is displaceable from a rest position remote from its associated conveying gap to the region of such conveying gap and operatively coupled with a drive mechanism. This drive mechanism respectively drives each folding blade through a work stroke and back at that moment when the conveying direction of the associated conveying gap reverses so as to move in synchronism with the conveying direction of the infeed station.

8 Claims, 7 Drawing Figures

APPARATUS FOR THE CONTINUOUS ZIGZAG FOLDING OF A MATERIAL WEB

BACKGROUND OF THE INVENTION

The present invention relates to a new and improved construction of apparatus for the continuous, zigzag-shaped folding of a material web or the like.

The folding apparatus of the invention is generally of the type comprising an infeed station for the material web and two conveying or feed gaps arranged following the infeed station at the outfeed or discharge portion thereof and located to respective opposite sides of said infeed station. The conveying gaps extend transversely and substantially parallely with respect to the direction of conveying of the material web by the infeed station. The conveying direction of the one conveying gap, in relation to the infeed station, is opposite to the conveying direction of the other conveying gap. Further, means are provided in order to reverse the conveying directions of both conveying gaps with respect to the infeed station.

Equipment of this type has become known to the art, for instance from German patent publication No. 2,134,898. In contrast to conventional pocket folding machines, where for the purpose of producing *n*-folds there are always required *n* plus 1 fold- or conveying gaps, which generally are formed by a roller frame containing *n* plus 2 rolls, equipment of the previously mentioned type possesses the advantage of being able to get by with only two folding- or conveying gaps, independent of the number of folds which are to be produced in one and the same material web. The prior art apparatuses of the previously mentioned type are equipped at the outfeed or discharge end of the infeed station with a return movement-blocking device which acts upon the material web. During the reversal of the conveying direction of the conveying or feed gaps, the section of the material web which is located between the reverse movement-blocking device and the one conveying gap, is forced to bendout or crease in the direction of the other conveying gap, in order to be seized and folded thereby. The state-of-the-art apparatuses of this type are only therefore poorly suitable for the zigzag-folding of a multi-layer material web, because the return movement-blocking device only is effective upon the outermost layer of such multi-layer material web. In particular, the prior art equipment is not suitable for further folding a material web which itself consists of a sheet folded in a zigzag-configuration in one direction, in a transversely extending direction, i.e. to form a cross-fold. Thus, for instance, with the heretofore known equipment of the prior art, while it is possible to fold large plans, such as shop or blue-prints, for instance of a size corresponding to DIN AO (German industrial standard AO) and larger in one direction in a zigzag-configuration to a smaller width, it is however not possible to further fold such sheet in a direction transverse thereto, because the "material web" which is available after the first series of folds has at its side edges the folds formed from the first folding operation, which tend to undesirably stiffen the material web in an unpredictable manner.

SUMMARY OF THE INVENTION

Hence, it is a primary object of the present invention to provide a new and improved construction of folding apparatus of the previously mentioned type which is particularly well suitable, although not exclusively, for folding multi-layer webs in a faultless manner into a zigzag-configuration.

Another object of the present invention aims at the provision of a new and improved construction of folding apparatus for folding a material web, typically sheets, foils and the like, into a zigzag-shape in an extremely reliable and positive manner, even if such webs are formed of a multiplicity of layers.

Yet a further object of the present invention aims at the provision of novel folding apparatus for the zigzag-like folding of material webs, which apparatus is relatively simple in construction and design, relatively economical to manufacture, extremely easy to use, reliable in operation, not readily subject to malfunction or breakdown, and requires a minimum of maintenance and servicing.

Now in order to implement these and still further objects of the invention, which will become more readily apparent as the description proceeds, the folding apparatus of the present development is manifested by the features that a folding blade or sword is operatively associated with each conveying gap. Each such folding blade can be itself shifted out of a rest position removed from the associated conveying gap to the region of such conveying gap and is operatively coupled with a drive mechanism. This drive mechanism respectively drives each folding sword through a work stroke and back into the rest position at that moment when the conveying direction of the associated conveying gap reverses so as to move in synchronism with the conveying direction of the infeed station. Stated in another way; the conveying gap at which the associated folding blade has moved into the work position and back again, exerts a conveying action on the material web which is in-phase with the conveying action exerted by the infeed station so as to promote the forward feed or advance of the material web through such conveying gap.

Instead of the return movement-blocking devices of the prior art equipment, with the proposed apparatus of the present invention there are thus employed the folding swords or blades which produce a pre-fold or crease exactly at the point of attack of the folding blade with the material web, this pre-fold or crease is then engaged by the associated conveying gap and folding of the pre-fold or the like completed. In contrast thereto, with the prior art equipment, the location at which there is formed the pre-fold at the section of the material web which is rearwardly conveyed due to bowing-out thereof against the return movement-blocking device, is more or less left completely to chance.

With a preferred constructional embodiment of the invention each folding blade is displaceably arranged in the tangential plane of the associated conveying or feed gap. Hence, each folding blade, in its rest position can be arranged at the side of the infeed station located opposite the associated conveying gap. Each folding blade can be coupled, for instance, by means of a coupling and a crank with a continuous drive or drive means, this coupling being controlled by the means for reversing the respective conveying direction of the conveying gaps.

Further, the folding blades can be forced under the action of a spring which biases them into the rest position. A construction which has been found to be particularly advantageous and operationally reliable is then realized if at the end of the work stroke the folding edges of the folding blades extend parallel to the conveying gaps. Of course, it is advantageous to select the length of the folding edge of the folding blade to be approximately of the same length as the length of the associated conveying gap.

In the event that the conveying gaps are formed by pairing a first roll with in each case one of two rolls, it is advantageous to pre-bias the second rolls by means of a spring in the direction of the first roll, so that these second rolls can be raised from the first roll against the action of such spring, with the beneficial result that there is automatically accommodated the increasing thickness of the resultant, folded product.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic sectional view of a preferred exemplary embodiment of folding apparatus constructed according to the invention, and for purposes of clarity omitting all of the unimportant parts, such as frame, base and the like.

DETAILED DESCRIPTION OF THE PREFERRED EMBODIMENTS

Figure 1:
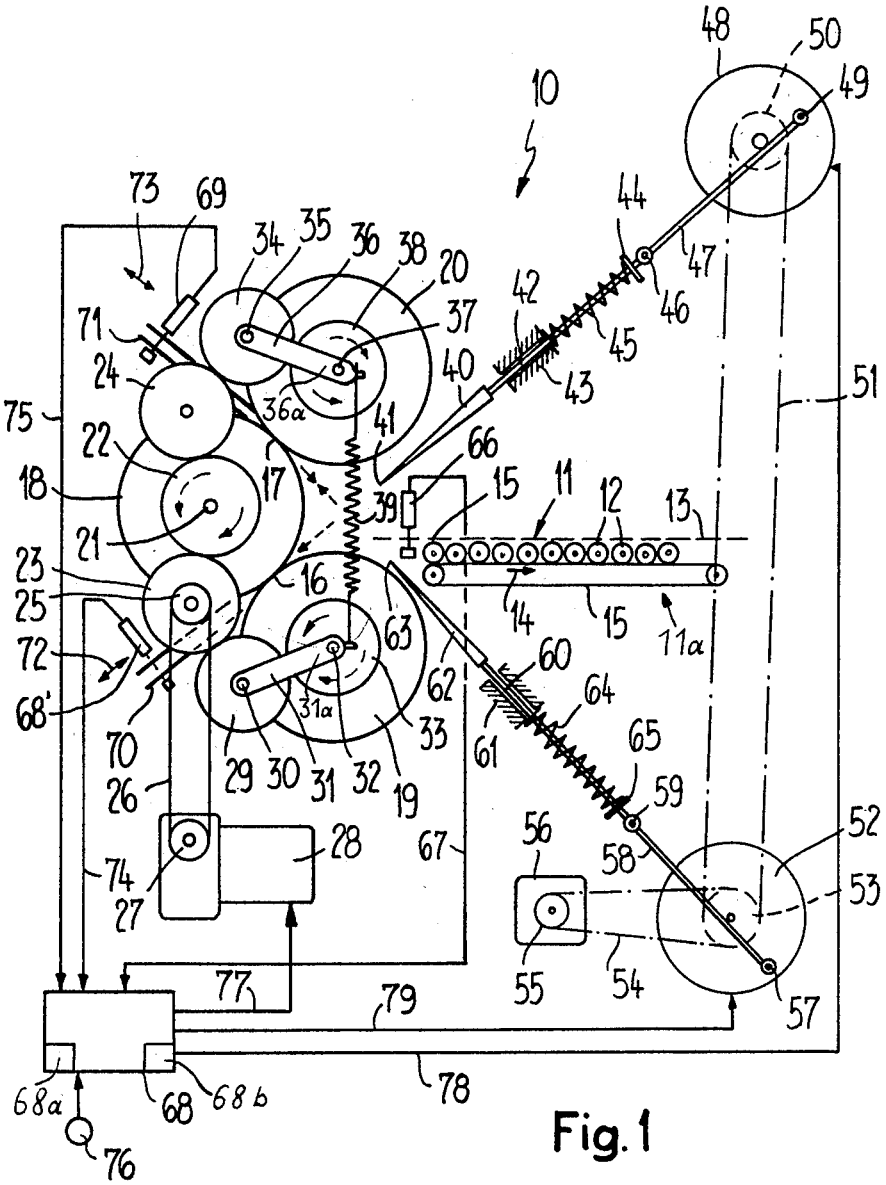
Figure 2:
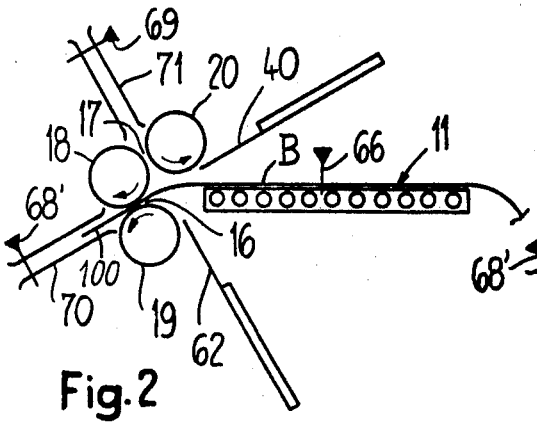
FIGS. 2 to 7 schematically illustrate, in a more simplified showing, different phases of the operation of the folding apparatus depicted in FIG. 1, in order to fully explain its function.

Describing now the drawings, the exemplary embodiment of folding machine 10, illustrated in FIG. 1, will be seen to comprise a bank of rolls 11 containing a number of rotatably mounted rolls or rollers 12 and forming an infeed station or location, generally indicated by reference character 11*a* in FIG. 1. The upper side of the bank of rolls 11 defines a conveying or feed plane 13 for the web of material which is to be folded into a substantially zigzag-shaped configuration, this web of material being indicated in FIG. 2 by reference character B. The thus defined conveying plane 13 has been indicated in FIG. 1 by the broken lines. The rolls 12 of the bank of rolls 11 frictionally engage at their lower portions with an endless drive belt or band 15 which is driven to revolve in the direction of the arrow 14. The rolls 12 are thus driven in a sense which conveys a web of material deposited upon the conveying or feed plane 13 in a direction from the right towards the left of FIG. 1. It should however be clearly understood that the drive for the rolls 12 is not a crucial feature of the invention, and thus, the rolls 12 of the bank of rolls 11 can be also driven in a different manner than that explained above purely by way of example.

The outfeed or discharge end 15 of the bank of rolls 11 have arranged downstream thereof, viewed with respect to the direction of conveying of the material web in the conveying plane 13, two conveying- or folding gaps 16 and 17. In the embodiment under discussion these conveying- or folding gaps 16 and 17 are formed by pairing a first roll 18 on the one hand with a roll 19 and on the other hand with a further roll 20. A gear 22 is seated upon and rigidly connected for rotation, for instance by being keyed, with the stationarily arranged shaft 21 of the roll 18. This gear 22 meshes both with a drive gear 23 as well as also with an intermediate gear 24 of the same diameter. The drive gear 23 is operatively coupled by means of a sprocket or chain wheel 25 and a chain 26 with the power take-off gear 27 of a transmission motor 28 or other suitable drive and meshes with a further intermediate gear 29. The stationarily arranged shaft 30 of the intermediate gear 29 simultaneously serves as the pivot axis for a rocker arm or balance 31, the free end 31*a* of which carries the shaft 32 of the roll 19. A gear 33 is seated upon this shaft 32 and is rigidly connected for rotation in any convenient fashion with the roll 19, this gear 33 thus always rotating in the opposite sense from the rotational sense of the gear 22.

A further intermediate gear 34 meshes with the intermediate gear 24 which is in meshing engagement with the gear 22. The stationary shaft 35 of this intermediate gear 34 at the same time serves as the pivot shaft for a rocker arm or balance 36 or equivalent structure. The free end 36*a* of this rocker arm or balance 36 carries the shaft 37 of the roll 20. A gear 38 is seated upon this shaft 37, gear 38 likewise being rigidly connected for rotation with the roll 20. Gear 38 continuously meshes with the intermediate gear 34. From the foregoing it will be apparent that also the roll 20 always rotates in the opposite sense in relation to the roll 18, i.e. either in the sense of the full-line arrows or in the sense of the broken-line arrows shown in FIG. 1.

Both of the rocker arms or balances 31 and 36 are interconnected at their free ends 31*a* and 36*a* by means of a tension spring 39, so that the second rolls 19, 20, pivotably arranged upon the rocker arms or balances 31, 36 respectively, always are resiliently pre-biased against the stationary roll or roller 18, but under the influence of the widening of the respective conveying gap 16 and 17 formed between such second rolls 19, 20 and the first roll 18 can be lifted-off such roll 18, without interrupting their drive.

Continuing, a folding blade or sword 40 equipped with a folding edge 41 is arranged in the tangential plane of the conveying or feed gap 16. This folding blade 40 is attached to the plungers or rods 42 (in FIG. 1 only one such plunger is visible), which in turn are mounted to be lengthwise displaceable in a guide sleeve 43 or equivalent structure. A spring 45 which bears at one end at the guide sleeve 43 and at the other end at a disc or plate 44 carried by the plunger 42, displaces this plunger 42 and thus the folding blade or sword 40 into the rest position illustrated in FIG. 1. At the end opposite the folding sword 40 the plunger 42 is articulated at hinge location 46 with a connecting rod 47, the other end of which is hingedly connected with a crankpin 49 excentrically mounted at one-half of an electromagentic single-revolution coupling or clutch 48. The other half of the single-revolution coupling 48 is rigidly connected for rotation with a sprocket wheel 50 which has only been shown schematically in broken lines. This sprocket wheel 50 is operatively coupled by means of a chain 51 with a further sprocket wheel 53 seated upon the driven half of a further single-revolution coupling or clutch 52. This sprocket wheel 53, constructed as a double wheel, is operatively connected by means of a chain 54 with the power take-off gear 55 of a transmission motor 56 or other suitable drive, which, with the folding machine 10 switched-on, is always turned-on in the same direction of rotation.

Mounted excentrically of the other connectable half of the single-revolution coupling 52 is a crankpin 57. Hingedly connected with the crankpin 57 is one end of a connecting rod 58, the other end of which is hingedly connected at location 59 with a plunger or rod 60. Just as was the case for the plunger 42 visible in the showing of FIG. 1, the plunger 60 also is mounted to be lengthwise displaceable in a guide bushing or sleeve 61. Further, the plungers 60 (only one of which is visible in FIG. 1) carry a folding blade or sword 62 equipped with the folding edge 63. Once again, a spring 64 which bears at one end at the guide bushing or sleeve 61 and at the other end at a disc or plate 65 attached to the plunger 60, forces such plunger 60 and together therewith the folding blade 62 into the rest position illustrated in FIG. 1. The folding blade 62 is located essentially in the tangential plane of the associated conveying or feed gap 17. A light barrier 66, for instance, constituted by a light source and photoelectric cell as is known in the art, is arranged at the region of the outfeed end 15 of the infeed station 11*a* defined by the bank of rolls 11. This light barrier 66 is connected by means of a line or conductor 67 with a suitable control circuit 68. The construction of such control circuit 68, which also contains a reversing switch 68*a* for the motor 28 and a timing element 68*b*, will be readily apparent from the hereinafter given description of the function of the folding machine or apparatus 10. Apart from receiving the output signal of the light barrier 66 the control circuit 68 also receives signals from further light barriers 68' and 69, which are disposed at the region of and following the conveying gaps 16 and 17 respectively, these light barriers 68' and 69 being adjustable at the guides 70 and 71 respectively, in the direction of the double-headed arrows 72 and 73 respectively, and conveniently fixed in their adjusted position. Further, these light barriers 68' and 69 are connected by the lines or conductors 74 and 75, respectively, with the control circuit 68. Power supply lines 77, 78 and 79 leading from the control circuit 68 which is connected with a suitable voltage source 76 lead to the transmission motor 28 and the single-revolution couplings or clutches 48, 52 respectively.

In order to fully appreciate the mode of operation of the heretofore described folding apparatus, and from which there will also be readily evident the construction of the control circuit 68, reference is now made to FIGS. 2 to 7. As soon as the leading edge 100 of a web of material B which is supported upon the bank of rolls 11 interrupts the light barrier 66, then by means of the control circuit 68 the drive motor 28 is turned-on to rotate in a sense such that the rolls 18 to 20 rotate in the directions of rotation illustrated by the full-line arrows shown in FIG. 2. Additionally, the light barriers 68' and 69 are activated. Consequently, this leading edge 100 of the material web B is engaged between the rolls 18 and 19 and conveyed through the conveying or feed gap 16 and displaced into the guide means or guide channel 70, as best seen by referring to FIG. 2.

Figure 3:
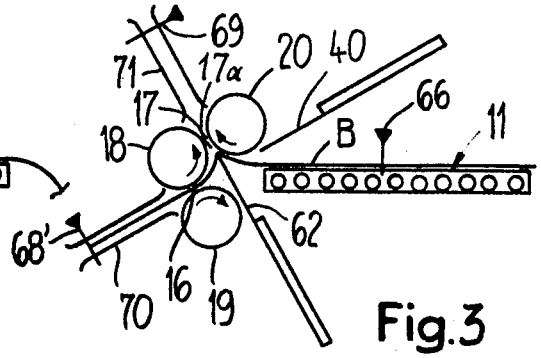

As soon as the leading edge 100 of the web B, when disposed in the guide means 70, interrupts the light barrier 68', then the reversing switch 68*a* for the drive motor 28, which reversing switch is part of the control circuit 68, is thrown into its other position, so that the rolls 18 to 20 then are driven to rotate in the directions indicated by the full-line arrows shown in FIG. 3. At the same time the control circuit 68 feeds a signal via the line 78 to the single-revolution coupling 52 so that the latter carries out one revolution, which, in turn, causes the related folding blade or sword 62 to perform a work stroke. The material web B which is now conveyed back through the conveying gap 16, is creased by the folding sword 62 and the folded or creased location of such web is pushed into the inlet opening 17*a* of the conveying gap 17 between the rolls 18 and 20. This has been shown in FIG. 3.

Figure 4:
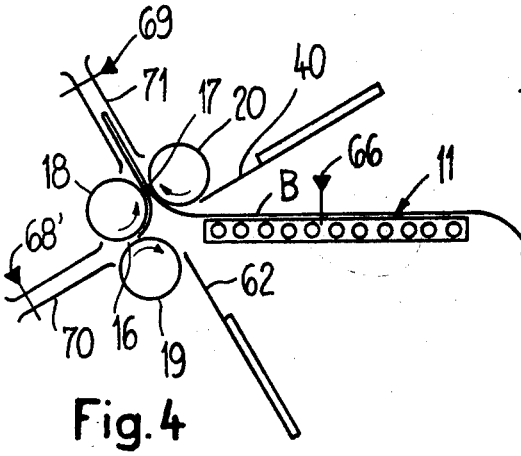

In FIG. 4 the conveying gap 17 now has folded the creased location of the web B and pushes such into the guide means 71, whereas the conveying gap 16 again completely releases the previously engaged or seized portion of the material web B.

Figure 5:
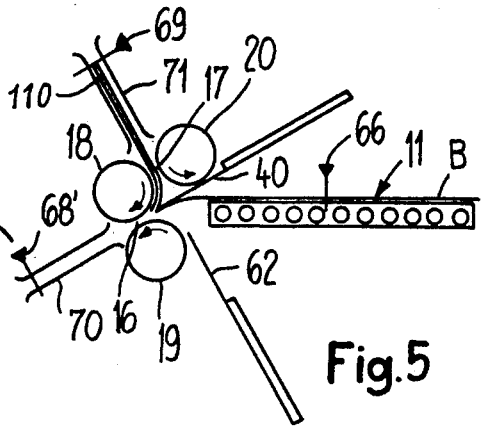
Figure 6:
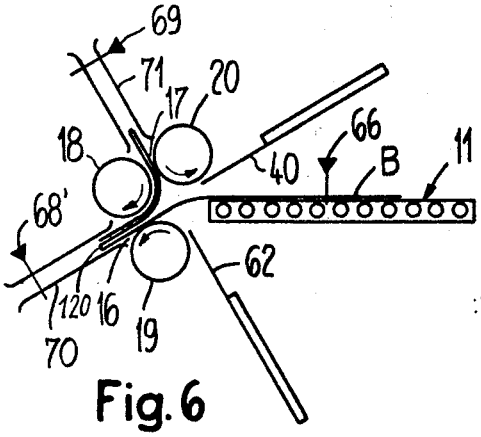

As soon as the first fold, generally indicated by reference character 110 in FIG. 5, interrupts the light barrier 69, then the control circuit 68 again reverses the direction of rotation of the rolls 18 to 20 and causes the single-revolution coupling 48 to carry out one revolution and therefore the folding blade 40 to carry out a work stroke. This folding blade 40 now pushes the section of the material web B which is located between the outfeed end 15 of the bank of rolls 11 and the conveying gap 17, while forming a crease or bend, again into the conveying gap 16, which now engages the leading edge of the web as well as the now formed crease, presses such together into a second fold 120 and pushes both folds 110 and 120 back towards the guide means 70, as shown in FIGS. 6 and 7.

Figure 7:
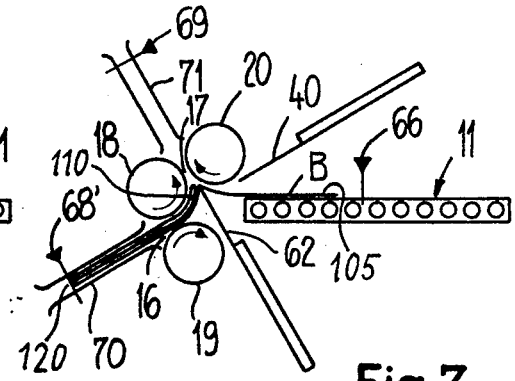

Now as soon as the light barrier 68' is again interrupted, as indicated in the showing of FIG. 7, there are repeated the operations described on the basis of the showing of FIG. 3. After the trailing edge 105 of the material web B again frees the light barrier 66, as indicated in FIG. 7, and the folding blade 62 carries out its work stroke, then the light barriers 68' and 69 are deactivated, and the drive motor 28, due to the action of the timing element 68*b* of the control circuit 68, still remains switched-on for a certain time duration in the existing direction of rotation until the completely folded material web has been ejected through the then conveying active-conveying gap (in FIG. 7 the conveying or feed gap 17) completely into the subsequently arranged guide means from where such folded material web can then be easily removed. This can be accomplished manually or by means of any suitable and not further illustrated conveyor device.

Although with the described folding apparatus or machine 10 the conveying or feed gaps 16 and 17 are formed by pairing the roll 18 on the one hand with the roll 19 and on the other hand with the roll 20, it should be understood that the conveying gaps also could be formed by pairing an endless revolving conveyor band or belt with a respective roll. Equally, it is to be appreciated that the folding blades or equivalent structure need not be necessarily moved linearly. These folding blades could equally carry out an arcuate-shaped work stroke. What is only important is that at the end of the work stroke the folding edges 41 and 63 of the folding blades 40 and 62, respectively, are located at the region of the related or associated conveying gap 16 and 17 respectively, or in fact penetrate therein. Also the drive mechanism which drives in each case the folding blades or the like for the purpose of carrying out their work stroke, can be differently constructed, for instance can be constituted by a cam disc, or there can even be used pneumatic or hydraulic drive systems.

As will be apparent from what has been explained above, the herein disclosed folding machine produces successive folds for such length of time as the light barrier 66 is not again freed, that is to say, e.g. during such time as the light beam thereof is interrupted by the material web. Hence, webs of random length can be folded together into a zigzag-configuration to a desired size or shape, which in turn is dependent upon the spacing of the light barriers 68' and 69 from the associated conveying gaps 16 and 17 respectively. This shape can be adjusted very simply by adjusting the position of the aforementioned light barriers. Equally, it is to be understood that both the light barrier 66 as well as also the light barriers 68' and 69 can be replaced by feeler switches or other equivalent type structure without having to basically alter the fundamental mode of operation of the folding machine or apparatus 10.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for the continuous, substantially zigzag-shaped folding of a material web, comprising:

means defining an infeed station for the material web for feeding the material web thereat in a given conveying direction;

said infeed station including an outfeed portion for said material web;

means defining a pair of conveying gaps, each arranged to a predetermined side of said infeed station following said outfeed portion;

each conveying gap being positioned to receive the material web supplied by said infeed station;

means provided for said means defining said pair of conveying gaps for imparting a predetermined conveying direction to the material web received in each conveying gap;

each conveying gap conveying the material web received therein in its predetermined conveying direction;

the predetermined conveying direction of any one conveying gap being opposite to the predetermined conveying direction of the other conveying gap;

means for reversing the predetermined conveying directions of both conveying gaps relative to one another;

a respective folding blade operatively associated with each conveying gap;

drive means for displacing each folding blade from a rest position removed from its associated conveying gap into a work position adjacent such conveying gap;

said drive means alternately driving each such folding blade through a work stroke into said work position and back again into said rest position at that moment in time when the conveying direction of the associated conveying gap reverses so as to be in synchronism with said given conveying direction of the infeed station;

said means defining said conveying gaps comprises a first roll and two second rolls;

said first roll being paired with each one of said second rolls;

spring means for pre-biasing said second rolls in the direction of said first roll;

said second rolls being raisable from said first roll against the action of said pre-biasing spring means.

2. The apparatus as defined in claim 1, further including:

means for mounting each folding blade to be forwardly displaceable in a plane which extends substantially tangentially of its associated conveying gap.

3. The apparatus as defined in claim 1, further including:

means for mounting each folding blade in its rest position at a side of the infeed station which is located opposite the associated conveying gap.

4. The apparatus as defined in claim 1, wherein:

said drive means for displacing said folding blades comprises:

continuous drive means; and a respective coupling and crank means provided for each folding blade for operatively connecting each said folding blade with said continuous drive means;

said means for reversing the conveying direction of the conveying gaps controlling said couplings.

5. The apparatus as defined in claim 4, further including:

spring means cooperating with each folding blade for forcing each said folding blade under the action thereof into its rest position.

6. The apparatus as defined in claim 1, wherein:

each folding blade has a folding edge; and said folding edges of said folding blades extending in a direction which is substantially parallel to said conveying gaps at least at the end of a work stroke.

7. The apparatus as defined in claim 6, wherein:

the length of the folding edge of each folding blade approximately corresponds to the length of its associated conveying gap.

8. The apparatus as defined in claim 1, wherein:

a respective shaft is provided for each second roll;

respective rocker means provided for each said shaft;

each said shaft of said second rolls being attached to one end to its associated rocker means; and tension spring means for interconnecting said ends of said rocker means with one another.

* * * * *